US006585623B1

(12) United States Patent
Hilmer-Gabcke

(10) Patent No.: US 6,585,623 B1
(45) Date of Patent: Jul. 1, 2003

(54) JAVELIN

(76) Inventor: Ute Hilmer-Gabcke, Auf der Wessel 4, D-37085 Göttingen (DE)

( * ) Notice: Subject to any disclaimer, the term of this patent is extended or adjusted under 35 U.S.C. 154(b) by 0 days.

(21) Appl. No.: 09/913,483

(22) PCT Filed: Jan. 25, 2000

(86) PCT No.: PCT/DE00/00197

§ 371 (c)(1),
(2), (4) Date: Aug. 13, 2001

(87) PCT Pub. No.: WO00/47292

PCT Pub. Date: Aug. 17, 2000

(30) Foreign Application Priority Data

Feb. 11, 1999 (DE) ..... 199 05 580

(51) Int. Cl.[7] ..... A63B 65/00
(52) U.S. Cl. ..... 482/20; 482/148
(58) Field of Search ..... 482/20, 148

(56) References Cited

U.S. PATENT DOCUMENTS 1,552,442 A * 9/1925 Lund ..... 482/20
1,731,686 A * 10/1929 Rinneberg ..... 482/20
1,994,089 A * 3/1935 Pipal ..... 482/20
2,044,092 A * 6/1936 Manzeck ..... 482/20
2,122,023 A * 6/1938 Campbell et al. ..... 482/20
2,196,610 A * 4/1940 Schlademan et al. ..... 482/20
3,216,727 A 11/1965 Hunter
3,746,334 A * 7/1973 Stubblefield ..... 482/20
4,333,643 A * 6/1982 Saffire ..... 482/20

FOREIGN PATENT DOCUMENTS

DE 29904549 6/1999
WO 9818400 5/1998
WO WO 98/18400 * 5/1998

* cited by examiner

*Primary Examiner*—Nicholas D. Lucchesi
*Assistant Examiner*—Lori Baker Amerson
(74) *Attorney, Agent, or Firm*—Horst M. Kasper

(57) ABSTRACT

The invention relates to a javelin, especially for use in an indoor arena, which is essentially comprised of a shaft (2) whose javelin tip (3) is blunt and which comprises a hand grip (4) that is situated in the proximity of the center-of-gravity of the javelin. The shaft (2) is constructed as a core which is enclosed by a sheathing (7) made of a elastic material.

29 Claims, 3 Drawing Sheets

JAVELIN

DESCRIPTION

Figure 1:
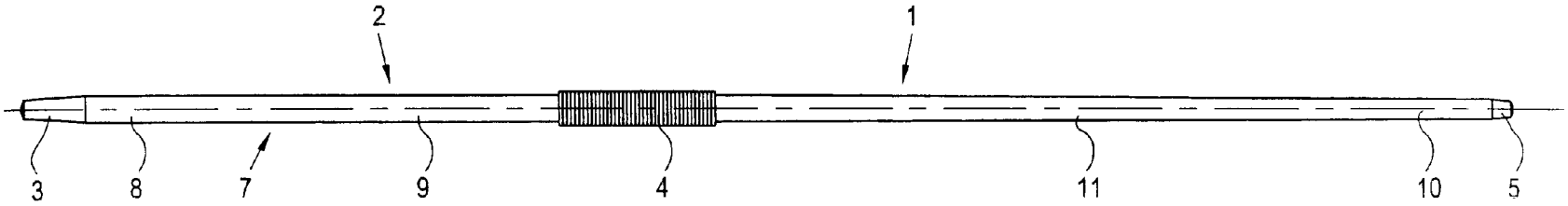

The Invention relates to a javelin, in particular for employment in a gymnasium hall, essentially comprising out of a shaft, where the point of the javelin of the shaft is formed plant and wherein the shaft exhibits a handle near the center of gravity of the shaft.

Regular javelins for sports purposes exhibit a tipped point of a javelin, wherein the regular javelins penetrate into the floor with the tipped point and remain stuck. These javelins are therefore not suitable to be employed in a gymnasium hall.

A javelin for training purposes is known in addition from the printed patent document WO 98/18400, wherein the javelin exhibits a dull point of a javelin, wherein the dull point of javelin is disposed at the front end of a staff. The staff exhibits three radially disposed sterilization fins at the rear end of the javelin. A handle, the so-called winding, is disposed between the point of the javelin and the end of the javelin. This training javelin is to serve specially the training in the javelin throwing of young trainees. The individual components of the training javelin are made of a plastic material.

It is a disadvantage in connection with the known javelin, that the javelin is lighter and smaller as are the usual competition javelins. According to one embodiment the known javelin has a length which is less than half the length of a competition javelin. In addition the competition javelins do not exhibit any stabilization fins.

In fact the training with this javelin is possible also in a gymnasium hall, but the training does not correspond however to the circumstances of a training with a competition javelin.

Thus this javelin is thrown with a clearly steeper angle as compared to a competition javelin.

Therefore it is an object of the present Invention to develop a javelin, which is on the one hand suitable for employment in a gymnasium hall and which on the other hand is substantially adapted to a competition javelin.

This object is accomplished in accordance with the present Invention by having the shaft made as a core, wherein the core is jacketed by a jacket made of an elastic material.

The javelin can be employed in a gymnasium hall by having the shaft jacketed with an elastic material. Without that, the javelin damages the floor of the gymnasium hall upon impingement onto the floor of the gymnasium hall.

According to a preferred embodiment of the Invention, the shaft is jacketed with a front jacket in the front region comprising the point of the javelin. The javelin is jacketed with the rear jacket in the rear region comprising the end of the javelin and disposed relatively remote from the point of the javelin.

It is possible to employ a conventional handle by having the jacket formed out of two parts, that is out of a front jacket and out of the rear jacket. In addition it is easier to attach the jacket at the shaft or, respectively at the core of the shaft.

According to a further preferred embodiment of the Invention, the jacket or, respectively, the front jacket and the rear jacket are formed out of a foam material.

A particular soft jacket can be obtained by employing a foam material, wherein the soft jacket saves the floor of the gymnasium hall upon impingement and impact.

According to another preferred embodiment of the Invention, the jacket is formed out of a foamed rubber. The elastic properties of foamed rubber are also suitable to avoid damaging the floor of the gymnasium hall upon impact of the javelin.

According to a further preferred embodiment of the Invention, the core is formed as a wood core.

It is possible to furnish substantially the weight and the dimensions of a usual competition javelin to the javelin.

It is further possible to form the core of the javelin as a plastic core or, respectively, as a fiber reinforced plastic core.

According to further preferred embodiment of the Invention, the point of the javelin is connected disengageably to the shaft. The point of the javelin is formed out of an elastic material at the free end of the point of the javelin disposed relatively remote to the shaft.

It is for example possible to form the front jacket like a tube and to slide the front jacket over the core based on the disengageable connection of the point of the javelin. In the following the front jacket can be fixed in its position by a connection of the point of the javelin with the core at the shaft or, respectively, with the core. In case of reviews of the javelin outdoors, it is additionally possible to exchange the elastic dull point of the javelin against a tipped point of the javelin.

According to further preferred embodiment of the Invention, the end of the javelin is disengageably connected to the shaft and the end of the javelin and formed at its free end disposed relatively remote to the shaft out of an elastic material.

For example, the rear jacket between the handle and the end of the javelin can be fixed to the shaft by attaching of the end of the javelin.

According to a further preferred embodiment of the Invention, the point of the javelin is furnished with a hollow chamber, wherein the hollow chamber is connected to openings disposed at the surface of the point of the javelin. The hollow chamber can be filled with a dye, wherein the dye exit is out of the openings upon impact of the javelin on the floor.

It is relatively simple to determine the location of impact of the javelin based on the dye exiting from the point of the spear.

Further details of the Invention result from the following detailed description and the accompanying drawings, wherein preferred embodiments of the Invention are illustrated by way of example in the drawings.

DETAILED DESCRIPTION OF THE DRAWING

Figure 2:
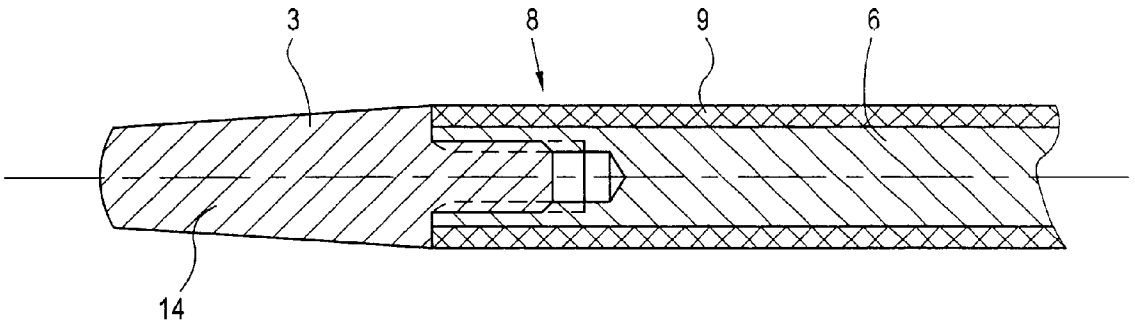
Figure 3:
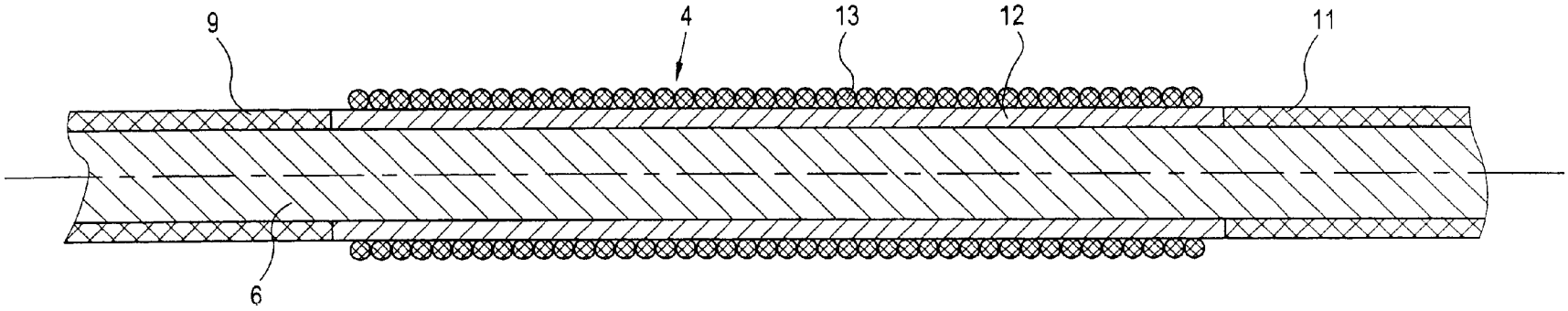
Figure 4:
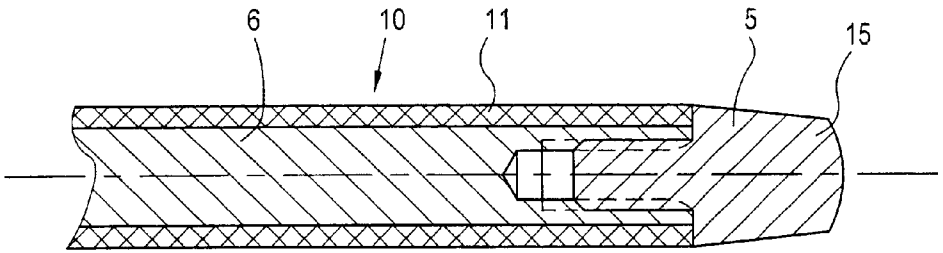
Figure 5:
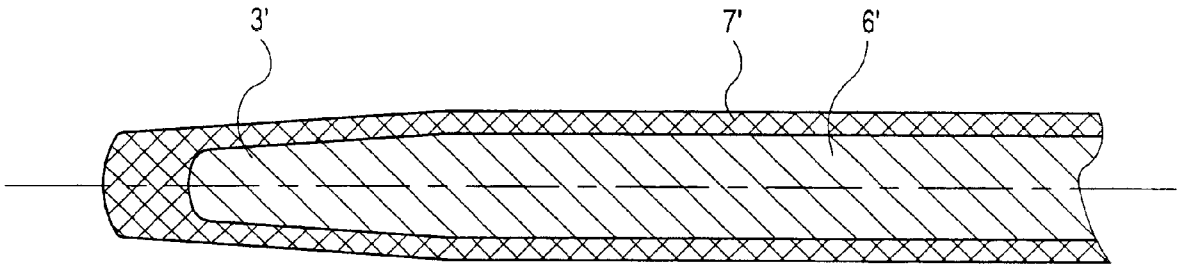
Figure 6:
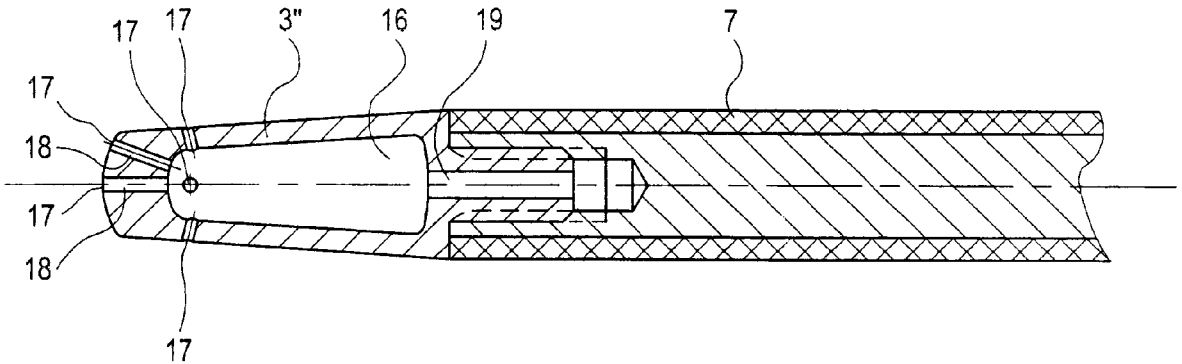

FIG. 1: a top planar view onto a javelin,

FIG. 2: a side view of the front region of the javelin of FIG. 1 in a section, FIG. 3: a side of the javelin of FIG. 1 in section in the area of the handle, FIG. 4: a side view in section of the rear region of the javelin of FIG. 1, FIG. 5: a front region of a javelin in section with the point of a javelin formed at the javelin, and FIG. 6: a side view of a front region of a shaft with a hollow chamber for receiving of dye in the point of the javelin in the section.

A javelin 1 comprises essentially a shaft 2, a point of a shaft 3, a handle 4 and an end 5 of the javelin.

The shaft 2 comprises a core 6, wherein the core 6 is jacketed by a jacket 7 made of an elastic material. Also a natural caoutchouc material or an artificial caoutchouc material can be employed. For example also foamed rubber is suitable.

The jacket 7 comprises a front jacket 9 in a front region 8 disposed toward the point 3 of the javelin and a rear jacket 11 in a rear region 10 disposed toward the end 5 of the javelin.

The core 6 is formed as a wood core. It is however also possible to form the core as a plastic core. It is further in principal possible to form the core out of a metal.

The handle 4 is disposed between the front region 8 and the rear region 10 about the area of the center of gravity. The handle is attached through a grip sleeve 12 at the core 6. A grip cord 13 is disposed on the grip sleeve 12, wherein the grip cord 13 forms the gripping area proper.

It is in principle also possible to dispense with the grip sleeve and to form the jacket 7 throughout over the shaft. The gripping cord 13 can then be placed directly onto the jacket 7.

The point 3 of the javelin is disengageably connected to the shaft 2 through a thread as it is also the end 5 of the javelin. The point 3 of the javelin at its free end 14 disposed relatively remote to the shaft 2 is formed out of an elastic material. The end 5 of the javelin at the free end 15 disposed relatively remote to the shaft is also made of an elastic material. The front jacket 9 is disposed between the point 3 of the javelin and the handle 4. The rear jacket 11 is disposed between the handle and the end 5 of the javelin.

According to another embodiment the tip 3' of the spear is a solidly connected to the core 6'. The tip 3' of the spear is also jacketed by the jacket 7'.

According to further embodiment of the disengageable point 3" of the javelin exhibits a hollow chamber 16, wherein the hollow chamber 16 is connected to openings 17 disposed at the surface of the point 3" of the javelin through channels 18. The point 3" on the end disposed relatively close to the shaft exhibits a filling channel 19 for filling of the hollow chamber 16.

The front jacket 9 is slid over the front region 8 of the shaft 2 or, respectively, of the core 6 for assembly of the javelin 1 such that the front jacket 9 contacts with the end of the front jacket 9 disposed relatively remote to the point 3 of the javelin against the handle 4. The front jacket 9 is fixed between the handle or, respectively, the grip support 12 of the handle and the point 3 of the javelin by screwing in of the point 3 of the javelin into the core 6.

The rear jacket 11 is the slid over the rear region 10 of the shaft 2 or, respectively, of the core 6 such that the end of the rear jacket 11 disposed remote relatively to the end of the javelin contacts against the handle 4. The rear jacket 11 is fixed on the core 6 by screwing in of the end 5 of the javelin into the core 6.

What is claimed is:

1. Javelin, in particular to be employed in a gymnasium hall, essentially comprising a shaft, wherein the point of the javelin is formed blunt and wherein the javelin exhibits a handle in the neighborhood of the center of gravity of the javelin, characterized in that the shaft (2) is formed as a core (6,6'), wherein the core (6,6') is jacketed by a jacket (7,7') made of an elastic material, wherein the point (3") of the javelin exhibits a hollow chamber (16), wherein the hollow chamber (16) is connected to openings (17) disposed at the surface of the point (3") of the javelin.

2. Javelin according to claim 1 characterized in that the shaft (2) is jacketed by a front jacket (9,9') in a front region (8) comprising the point (3,3',3") of the javelin.

3. Javelin according to claim 1 characterized in that the shaft (2) is jacketed in a rear region (10) comprising an end (5) of the javelin disposed relatively remote to the point (3,3', 3") of the javelin with a rear jacket (11).

4. Javelin according to claim 1, characterized in that the jacket (7,7', 9,9', 11) is formed out of a caoutchouc.

5. Javelin according to claim 1, characterized in that the jacket (7,7', 9,9', 11) is formed out of a foamed rubber.

6. Javelin according to 1, characterized in that core (6,6') is formed as a plastic core.

7. Javelin according to claim 1, characterized in that the jacket (7,7', 9,9', 11) is removable.

8. Javelin according to claim 1, characterized in that the end (5) of the javelin is connected disengageably to shaft (2).

9. Javelin according to claim 1, characterized in that the end (5) of the javelin is screwable to the shaft (2).

10. Javelin according to claim 1, characterized in that the front jacket (9) is disposed between the point (3,3") of the javelin and in the handle (4).

11. Javelin according to claim 10 characterized in that the rear jacket (11) is disposed between the handle (4) and the end (5) of the javelin.

12. Javelin according to claim 1 characterized in that the hollow chamber (16) is fillable with a dye, wherein the dye exits upon impact of the shaft 2 on the floor.

13. Javelin according to claim 12 characterized in that the dye is formed as a powder.

14. Javelin according to claim 1, characterized in that the core is formed as a metal core.

15. Javelin, in particular to be employed in a gymnasium hall, essentially comprising a shaft, wherein the point of the javelin is formed blunt and which shaft exhibits a handle in the neighborhood on the center of gravity, characterized in that the javelin is substantially adapted to a competition javelin, and that the shaft (2) is formed as a core (6, 6') wherein the core (6, 6') is jacketed by a jacket (7, 7') made of an elastic material, and that said core (6, 6') is formed as a cylindrical hollow body, and that the point (3, 3') of the javelin is connected disengageably to the shaft (2).

16. Javelin according to claim 15, characterized in that the jacket (7,7,9,9', 11) is made out of a plastic material.

17. Javelin according to claim 15, characterized in that the jacket (7,7', 9,9', 11) is formed out of a foaming material.

18. Javelin according to claim 15 characterized in that the core (6, 6') is formed as a wooden core.

19. Javelin according to claim 15 characterized in that the core (6,6') is made of a glass fiber reinforced plastic.

20. Javelin according to 15, characterized in that the point (3,3',3") of the javelin is formed out of an elastic material at the free end (14) of the point (3,3',3") of the javelin disposed relatively remote to the shaft.

21. Javelin according to claim 14, characterized in that the jacket (7,7') is disposed between the point (3,3") of the javelin and the end (5) of the javelin.

22. Javelin according to claim 15 characterized in that the shaft (2) is jacketed by a front jacket (9,9') in a front region (8) comprising the point (3,3',3") of the javelin.

23. Javelin according to claim 15 characterized in that the shaft (2) is jacketed in a rear region (10) comprising an end (5) of the javelin disposed relatively remote to the point (3,3', 3") of the javelin with a rear jacket (11).

24. Javelin according to 15, characterized in that core (6,6') is formed as a plastic core.

25. Javelin according to claim 15, characterized in that the jacket (7,7', 9,9', 11) is removable.

26. Javelin according to claim 15, characterized in that the core is formed as a metal core.

27. Javelin, in particular to be employed in a gymnasium hall, essentially comprising a shaft, wherein the point of the javelin is formed blunt and which shaft exhibits a handle in the neighborhood on the center of gravity, characterized in that the javelin is substantially adapted to a competition javelin, and that the shaft (2) is formed as a core (6, 6') wherein the core (6, 6') is jacketed by a jacket (7, 7') made of an elastic material, and that said core (6, 6') is formed as a cylindrical hollow body, and that the point (3, 3') of the javelin is connected disengageably and screwable to the shaft (2).

28. Javelin, in particular to be employed in a gymnasium hall, essentially comprising a shaft, wherein the point of the javelin is formed blunt and which shaft exhibits a handle in the neighborhood on the center of gravity, characterized in that the javelin is substantially adapted to a competition javelin, and that the shaft (2) is formed as a core (6, 6') wherein the core (6, 6') is jacketed by a jacket (7, 7') made of an elastic material, and that said core (6, 6') is formed as a cylindrical hollow body, and that the point (3, 3') of the javelin is connected disengageably and screwable to the shaft (2), and that the end (5) of the javelin is connected disengageably and screwable to the shaft (2).

29. Javelin according to claim 28, characterized in that the end (5) of the javelin at its free end (15) disposed relatively remote to the shaft is formed out of an elastic material.

* * * * *